US010393437B2

(12) United States Patent
Niwa et al.

(10) Patent No.: US 10,393,437 B2
(45) Date of Patent: Aug. 27, 2019

(54) MELTING MATERIAL SUPPLY APPARATUS

(71) Applicant: AISIN TAKAOKA CO., LTD., Toyota-shi, Aichi (JP)

(72) Inventors: Kazufumi Niwa, Toyota (JP); Hiroaki Kato, Toyota (JP); Yusuke Wakita, Toyota (JP); Yuki Kiyanagi, Toyota (JP)

(73) Assignee: AISIN TAKAOKA CO., LTD., Toyota-Shi, Aichi (JP)

( * ) Notice: Subject to any disclaimer, the term of this patent is extended or adjusted under 35 U.S.C. 154(b) by 0 days.

(21) Appl. No.: 15/763,687

(22) PCT Filed: Sep. 2, 2016

(86) PCT No.: PCT/JP2016/075836
§ 371 (c)(1),
(2) Date: Mar. 27, 2018

(87) PCT Pub. No.: WO2017/056848
PCT Pub. Date: Apr. 6, 2017

(65) Prior Publication Data

US 2018/0320971 A1 Nov. 8, 2018

(30) Foreign Application Priority Data

Sep. 28, 2015 (JP) ..... 2015-189557

(51) Int. Cl.
*F27D 3/06* (2006.01)
*F27B 14/12* (2006.01)
*F27D 1/18* (2006.01)

(52) U.S. Cl.
CPC ..... *F27B 14/12* (2013.01); *F27D 1/18* (2013.01); *F27D 1/1808* (2013.01); *F27D 3/06* (2013.01)

(58) Field of Classification Search
CPC ... F27B 14/12; F27D 1/18; F27D 3/06; F27D 17/001
(Continued)

(56) References Cited

U.S. PATENT DOCUMENTS 3,080,158 A * 3/1963 Stenzel ..... F27D 3/06 193/4
4,089,640 A 5/1978 Overmyer et al.
(Continued)

FOREIGN PATENT DOCUMENTS

CN 203893672 U 10/2014
JP S52-145546 U1 11/1977
(Continued)

OTHER PUBLICATIONS

Korean Office Action dated Jun. 19, 2018 issued by the Korean Patent Office in corresponding Korean Patent Application No. 10-2018-7011590, with English-language translation (8 pages).
(Continued)

*Primary Examiner* — Mark C Hageman
(74) *Attorney, Agent, or Firm* — Buchanan Ingersoll & Rooney PC

(57) ABSTRACT

The purpose of the present invention is to provide a melting material supply apparatus which is capable of contributing to improvements in the working environment and the melting efficiency of a metal melting furnace, and which is also capable of making melting work more efficient. This melting material supply apparatus for supplying a melting material to a crucible is provided with: a melting material supply unit for supplying the melting material to the crucible; and a furnace lid for closing an opening provided in the upper part of the crucible. The furnace lid is supported in a horizontal state by a furnace lid-supporter, and is capable of being moved between a position in which the opening is closed,
(Continued)

and a standby position located above a hood. When the furnace lid is in the standby position, the opening is open, and the melting material can be supplied into the crucible therefrom.

6 Claims, 4 Drawing Sheets

(58) Field of Classification Search
USPC ..... 414/163, 164
See application file for complete search history.

(56) References Cited

U.S. PATENT DOCUMENTS 4,151,919 A * 5/1979 Blase ..... C10B 43/06 15/93.2
6,036,914 A * 3/2000 Diederich ..... B22D 45/005 266/142
6,099,229 A * 8/2000 Knoch ..... C10B 25/24 202/241
8,596,945 B2 * 12/2013 Knoch ..... C10B 31/04 202/262
8,714,899 B2 * 5/2014 Schuecker ..... C10B 25/24 414/164

FOREIGN PATENT DOCUMENTS

JP S58-092790 A 6/1983
JP S61-016915 B2 5/1986
JP H07-133987 A 5/1995
JP 11-029814 A 2/1999
JP 2003-164960 A 6/2003

OTHER PUBLICATIONS

International Search Report (PCT/ISA/210) dated Nov. 29, 2016, by the Japan Patent Office as the International Searching Authority for International Application No. PCT/JP2016/075836.
Written Opinion (PCT/ISA/237) dated Nov. 29, 2016, by the Japan Patent Office as the International Searching Authority for International Application No. PCT/JP2016/075836.
International Preliminary Report on Patentability (PCT/IPEA/409) dated Oct. 2, 2017, by the Japan Patent Office as the International Preliminary Examining Authority for International Application No. PCT/JP2016/075836 (with English translation of annexes).
Office Action dated Jul. 28, 2017, by the Japan Patent Office for corresponding Japanese Patent Application No. JP 2015-189557.
Office Action (The Third Office Action) dated May 13, 2019, by the State Intellectual Property Office (SIPO) of the People's Republic of China in corresponding Chinese Patent Application No. 201680054846.0 and an English Translation of the Office Action. (11 pages).

* cited by examiner

MELTING MATERIAL SUPPLY APPARATUS

TECHNICAL FIELD

The present disclosure relates to a melting material supply apparatus configured to supply a melting material to a metal melting furnace.

BACKGROUND ART

In a casting process or the like for manufacturing casts by pouring molten metal into a casting mold, a metal melting furnace is used for melting a melting material (metal). In general, the metal melting furnace employs an induction furnace system configured to heat a melting material in a crucible by generating an induction current therein (for example, see Patent Literature 1).

The metal melting furnace of this type is provided in combination with a melting material supply apparatus configured to measure a required amount of the melting material for every casting process and supply the measured melting material into the crucible. With the melting material supply apparatus provided in combination, a casting cycle including supply of material, heating of material, transfer of a molten metal is established (see also Patent Literature 1).

CITATION LIST

Patent Literature

Patent Literature 1: Japanese Patent Laid-Open No. 2003-164960

SUMMARY OF DISCLOSURE

Technical Problem

In the metal melting furnace of the related art, an opening of the crucible is left opened toward outside. If the opening is left opened in this manner, heat in the crucible is dissipated through the opening during a process of melting the melting material, which may result in a problem of lowering of melting efficiency and deterioration of working environment around the metal melting furnace. Therefore, there has been room to study about possibilities to provide the melting material supply apparatus combined with the metal melting furnace with a function which addresses the heat dissipation issue.

Accordingly, it is an object of the present disclosure to provide a melting material supply apparatus which contributes to improving melting efficiency of the metal melting furnace and a working environment as well as achieving a melting operation with improved efficiency.

Solution to Problem

In order to achieve the above-described object, a first disclosure provides a melting material supply apparatus combined with a metal melting furnace for melting a melting material supplied to a crucible and configured to supply the melting material to the crucible, characterized in that the melting material supply apparatus includes: a melting material supply unit configured to supply a melting material to the crucible; a means configured to move the melting material supply unit between a position for supplying the melting material to the crucible and a position retracted therefrom and apart from the crucible which has been supplied with the melting material at the position for supplying; a furnace lid provided integrally with the melting material supply unit and configured to cover an opening provided at a top of the crucible; furnace lid-supporting means configured to support the furnace lid in a horizontal state; and furnace lid moving means configured to move the furnace lid supported by the furnace lid-supporting means between a first position at which the furnace lid is placed at the opening to cover the opening and a second position at which the opening is opened to allow a supply of the melting material.

The second disclosure according to the first disclosure is characterized in that the melting material supply unit has a hood disposed above the opening at the time of loading the melting material into the crucible and having a material outlet port configured to lead out the melting material downward, and in that the furnace lid at the first position is placed below the hood.

A third disclosure according to the second disclosure is characterized in that the furnace lid moving means-moves the furnace lid between the first position and the second position below the melting material supply unit.

A fourth disclosure according to the first disclosure is characterized in that the melting material supply unit has the hood disposed above the opening at the time of supplying loading the melting material into the crucible and having a material outlet port configured to lead out the melting material downward, in that the furnace lid at the first position is placed in front of the hood, and the furnace lid at the second position is placed above the hood, and in that the furnace lid moving means moves the furnace lid so as to circumvent the hood when moving the furnace lid between the first position and the second position.

A fifth disclosure according to any one of the first to fourth disclosures is characterized in that the furnace lid-supporting means has an inclination following mechanism configured to cause the furnace lid to incline so as to follow an inclination of a contact portion with respect to the opening.

Advantageous Effect of the Disclosure

According to the first disclosure, by moving the furnace lid to the second position by the furnace lid moving means, the opening of the crucible is opened and thus the supply of the melting material from the melting material supply unit into the crucible is allowed. After the melting material is supplied, the furnace lid is moved to the first position and the melting material is melted by induction heating or the like. At this time, as the furnace lid is placed at the opening of the crucible, heat in the crucible is hardly dissipated to the outside, and thus the melting efficiency and the working environment are improved.

In addition, in a state of retaining a molten metal, which is obtained by melting the melting material, in the crucible, the opening of the crucible may be kept covered by leaving the furnace lid placed at the first position. Therefore, the furnace lid may also be used as a furnace lid for retention of the molten metal. Accordingly, provision of another furnace lid as an additional apparatus and setting of the furnace lid by an operator for the retention of the molten metal are not necessary, and thus efficiency of the melting operation is also improved.

According to the second disclosure, the furnace lid moved to the first position and being in a state of covering the opening of the crucible is placed below the hood. By moving the furnace lid from below the hood to the second position, the opening of the crucible is positioned below the hood, and thus the supply of the melting material from the material outlet port of the hood into the crucible is allowed. In other words, the melting material supply apparatus do not have to be moved for supplying the melting material and for melting the supplied melting material, and thus the efficiency of the melting operation is improved correspondingly.

According to the third disclosure, the furnace lid moving means is configured to move the furnace lid between the first position and the second position below the melting material supply unit, and an area for moving the furnace lid and an area used for the melting material supply unit may be provided separately in a vertical direction. Accordingly, complication in structure due to interference of one configuration with the other configuration is restricted.

According to the fourth disclosure, the furnace lid is moved between the first position to cover the opening of the crucible and the second position to open the opening so as to circumvent the hood. The furnace lid moved to the first position is placed in front of the hood. Therefore, by placing the hood at a position closer to the opening of the crucible, a distance between the material outlet port of the hood and the opening may be reduced. Accordingly, the melting material is restricted from splashing around when the melting material is supplied to the crucible, and thus a required amount of melting material may be supplied further reliably.

According to the fifth embodiment, as the furnace lid-supporting means includes an inclination following mechanism, even when the opening of the crucible is inclined, the furnace lid is placed at the opening of the crucible in a state of inclining so as to follow the inclination. Accordingly, even though the opening of the crucible is inclined, formation of an excessive gap between a peripheral edge of the opening and the furnace lid, which may lead to heat dissipation therefrom, may be restricted.

DESCRIPTION OF EMBODIMENTS

Figure 1:
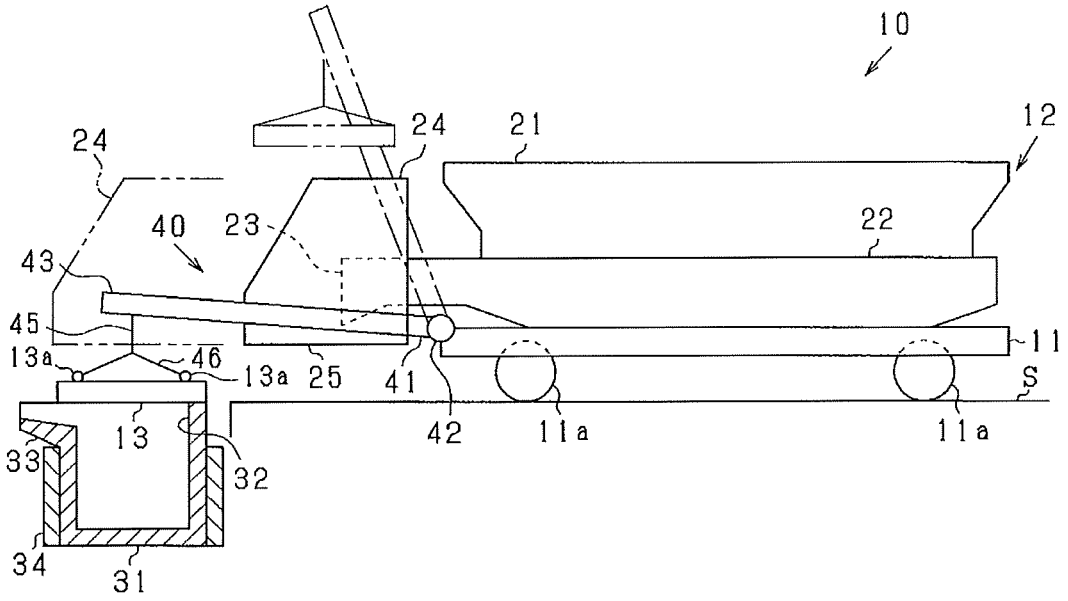
FIG. 1 is a side view schematically illustrating a melting material supply apparatus of a first embodiment.

Referring now to the drawings, embodiments in which the present disclosure is embodied will be described in detail.

First Embodiment

Figure 2:
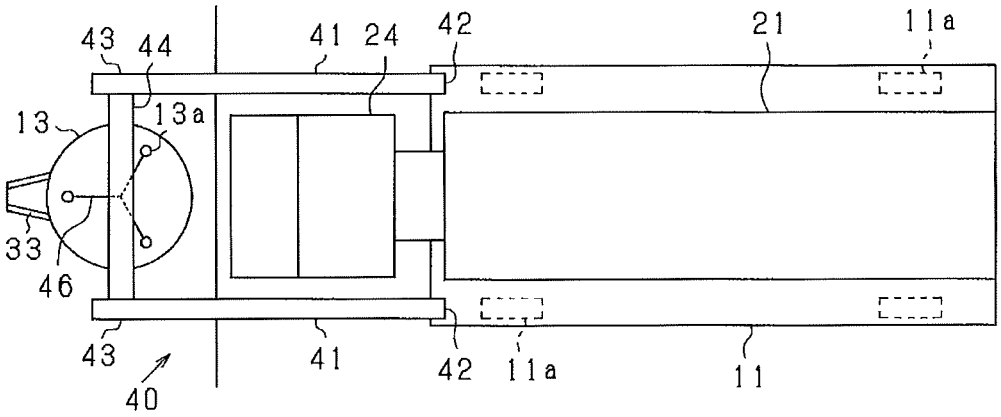
FIG. 2 is a plan view of FIG. 1.

Referring first to FIG. 1 and FIG. 2, a configuration of a melting material supply apparatus combined with a metal melting furnace according to a first embodiment will be described. FIG. 1 is a side view schematically illustrating the melting material supply apparatus of the first embodiment, and FIG. 2 is a plan view of FIG. 1.

As illustrated in FIG. 1 and FIG. 2, a melting material supply apparatus 10 of the first embodiment includes a base unit 11 and a melting material supply unit 12. The base unit 11 includes a plurality of (four in the first embodiment) wheels 11*a*, and is capable of moving in one direction (a lateral direction in FIG. 1, which will be referred to as "movement direction", hereinafter) on a traveling path S. A configuration to enable the melting material supply apparatus 10 to move may be a rail or the like.

A melting material supply unit 12 is installed on the base unit 11, and includes a hopper 21 and a material feeder 22. The hopper 21 is a container for storing a melting material such as cast iron or the like, and is opened on top. The melting material is loaded from the open portion, and the melting material is stored in the hopper 21.

The material feeder 22 is provided at a lower end portion of the hopper 21. The material feeder 22 is, for example, an oscillation conveyer or a belt conveyer, and has a function to feed a predetermined amount of the melting material stored in the hopper 21. The material feeder 22 is provided with a material output portion 23 at a distal end thereof on one side in the movement direction (hereinafter, referred to as a "front side"). The hood 24 is provided around the material output portion 23, and the material output portion 23 is covered with the hood 24. A material outlet port 25 configured to lead the material to fall downward is provided at a lower portion of the hood 24. The predetermined amount of the melting material led out from the material output portion 23 is guided to the material outlet port 25 by the hood 24 in a state of being restricted from splashing around, and is fallen downward therefrom.

A crucible 31 of the metal melting furnace is provided on the front side of the movement direction where the hood 24 is provided. The crucible 31 is a bottomed cylindrical container. An opening 32 is provided on top of the container, and through the opening 32, the melting material is loaded into the crucible 31. The crucible 31 is provided so that an upper end thereof comes substantially to the same level as that of the traveling path S. The crucible 31 is provided at the upper end thereof with a spout 33 projecting sideward from the opening 32.

The metal melting furnace in this specification employs an induction heating system, and an induction coil 34 is provided on the crucible 31 so as to surround a periphery of the cylindrical portion. The melting material stored in the crucible 31 is subjected to induction heating by passing an AC current through the induction coil 34, whereby the melting material is melted.

The melting material supply apparatus 10 of the first embodiment is provided with a furnace lid 13 to be placed at the opening 32 of the crucible 31. The furnace lid 13 is supported by a furnace lid-supporting device 40, and is provided on the melting material supply apparatus 10 in a state of being capable of changing in position. The furnace lid-supporting device 40 here corresponds to furnace lid-supporting means and furnace lid-moving means.

The furnace lid-supporter 40 includes a pair of arm members 41 as illustrated in FIG. 2. The respective arm members 41 are provided so as to extend in the movement direction from a front end of the base unit 11 to the front side of the hood 24 along both sides of the hood 24. Therefore, the pair of arm members 41 extend in parallel in plan view. Each of the arm members 41 is configured to be pivotable about a proximal end 42 thereof as an axis of pivotal movement.

The pivotal movement of the arm member 41 is achieved by driving a rotating drive unit (not illustrated). Examples of conceivable rotating drive unit (not illustrated) include a cylinder coupled at distal end of a rod to the arm member 41. In this case, by driving the cylinder and retracting the rod, the arm members 41 may be pivoted from a lying position to a raised position.

A lateral member 44 is bridged between distal ends 43 of the respective arm members 41. An end of a first suspension line 45 is coupled to the lateral member 44 at a center portion in the longitudinal direction. On the other hand, at least three joint portions 13*a* are provided on a peripheral edge portion of the furnace lid 13 equidistantly from a center of gravity of the furnace lid 13. Second suspension lines 46 are coupled to the respective joint portions 13*a* and converged toward a vertical line including the center of gravity of the furnace lid 13. The other end of the first suspension line 45 is connected to a point where the second suspension lines 46 are converged. Therefore, the center of gravity of the furnace lid 13 exists on an extension of the first suspension line 45. In this configuration, the furnace lid 13 is suspended and supported by the lateral member 44 in a horizontal state by means of the first suspension line 45 and the second suspension lines 46.

The suspension lines 45, 46 here include an elongated suspension tool such as a wire, a chain, and the like which is tensed in a state of suspending an object and is loosened when both ends get closer to each other to a distance shorter than an entire length thereof.

By making the respective arm members 41 lie down to move the furnace lid 13 downward, the furnace lid 13 is placed at the opening 32 of the crucible 31 and the opening 32 is covered as illustrated in a solid line in FIG. 1. The position of the furnace lid 13 corresponds to the first position. In contrast, by pivoting and raising the respective arm members 41 from this position, the furnace lid 13 may leave the opening 32 and move to an upper level of the hood 24 as illustrated by a two-dot chain line in FIG. 1. Accordingly, the opening 32 is opened and thus allows a supply of the melting material from above the opening 32. A position of the furnace lid 13 above the hood 24 is defined as a waiting position, and the waiting position corresponds to the second position.

When the melting material supply apparatus 10 having the configuration described thus far is used to supply the melting material to the crucible 31, a procedure as described below is performed.

First, when the melting material is supplied, the furnace lid 13 is placed at the waiting position, and in this state, the melting material supply apparatus 10 is moved forward to place the hood 24 above the opening 32 of the crucible 31 (see the two-dot chain line in FIG. 1). In this state, a predetermined amount of the melting material stored in the hopper 21 is fed by the material feeder 22 of the melting material supply unit 12. Accordingly, the melting material is led out from the material output portion 23, and the predetermined amount of the melting material falls downward from the material outlet port 25 of the hood 24. As the opening 32 of the crucible 31 exists in that downward area, the melting material is supplied to the crucible 31.

Next, the melting material supply apparatus 10 is retracted, and then the respective arm members 41 are pivoted and laid down to a position where the furnace lid 13 covers the opening 32 of the crucible 31. Accordingly, the opening 32 of the crucible 31 is covered with the furnace lid 13. Therefore, by passing a current through the induction coil 34 to effect induction heating on the melting material in the crucible 31, heating of the melting material is achieved while heat dissipation is restricted. For retention of the molten metal obtained by melting the melting material, the retention of the molten metal in the crucible 31 in a state of restricting the heat dissipation is achieved by maintaining the state in which the opening 32 is covered with the furnace lid 13.

An extent of retraction of the melting material supply apparatus 10 is set depending on the length of the respective arm members 41, the suspending position of the furnace lid 13, and the like so that the furnace lid 13 is placed at the opening 32 when the arm members 41 are laid down.

The suspension lines 45, 46 that suspend and support the furnace lid 13 are configured to be capable of being shortened by sagging (loosening). Therefore, when the upper end of the crucible 31 is not horizontal and is slightly inclined, the arm members 41 may further be laid down to absorb the inclination of the crucible 31 by the looseness of the suspension lines 45, 46. Accordingly, formation of the gap between the peripheral edge (contact portion) of the opening 32 of the crucible 31 and the furnace lid 13 is restricted. In this case, the suspension lines 45, 46 correspond to the inclination following mechanism.

When the molten metal in the crucible 31 is used, the arm members 41 are pivoted to the raised position to restore the furnace lid 13 to the waiting position. Accordingly, the state in which the opening 32 of the crucible 31 is opened is achieved. Subsequently, when supplying the melting material into the crucible 31 again, the melting material supply apparatus 10 at the retracted position is moved forward, so that the hood 24 is placed above the opening 32 of the crucible 31 (see the two-dot chain line in FIG. 1). In this state, the supply of the melting material is performed as described above.

Simultaneously with advancement and retraction of the melting material supply apparatus 10, the movement of the furnace lid 13, that is, the movement between the waiting position and the position to cover the opening 32 may be performed.

According to the melting material supply apparatus 10 of the first embodiment described thus far, the following effects are achieved.

When the arm members 41 are raised to place the furnace lid 13 at the waiting position, a state in which the opening 32 of the crucible 31 is opened is achieved, and thus the supply of the melting material from the melting material supply unit 12 into the crucible 31 is allowed. After the melting material is suppled, the arm members 41 are laid down to place the furnace lid 13 at the opening 32 to cover the opening 32 by the furnace lid 13. By melting the melting material in this state, heat in the crucible 31 can hardly be dissipated to the outside. Accordingly, melting efficiency and working environment are improved.

For retaining the molten metal obtained after the melting material is melted in the crucible 31 as well, the state in which the opening 32 of the crucible 31 is covered continues by leaving the furnace lid 13 placed at the opening 32, and thus the furnace lid 13 may be used also during the retention of the molten metal. Accordingly, provision of another furnace lid 13 as an additional device and setting of the furnace lid 13 by an operator for the retention of the molten metal are not necessary, and thus efficiency of the melting operation is also improved.

The furnace lid 13 is moved by the furnace lid-supporter 40 between a position to cover the opening 32 of the crucible 31 and a position to open the opening 32 so as to circumvent the hood 24. The furnace lid 13 in the state of covering the opening 32 is placed in front of the hood 24. Therefore, by placing the hood 24 at a position closer to the opening 32 of the crucible 31, a distance between the material outlet port 25 of the hood 24 and the opening 32 of the crucible 31 may be reduced. Accordingly, the melting material is restricted from splashing around when the melting material is supplied to the crucible 31, and thus a required amount of melting material may be supplied further reliably.

Since the furnace lid 13 is suspended and supported by the suspension lines 45, 46, when the upper end of the crucible 31 is inclined, the arm members 41 may further be laid down to absorb the inclination of the crucible 31 by the looseness of the suspension lines 45, 46. Accordingly, an event in which a gap is formed between the peripheral edge of the opening 32 of the crucible 31 and the furnace lid 13 and heat is dissipated therefrom is restricted.

Second Embodiment

Figure 3:
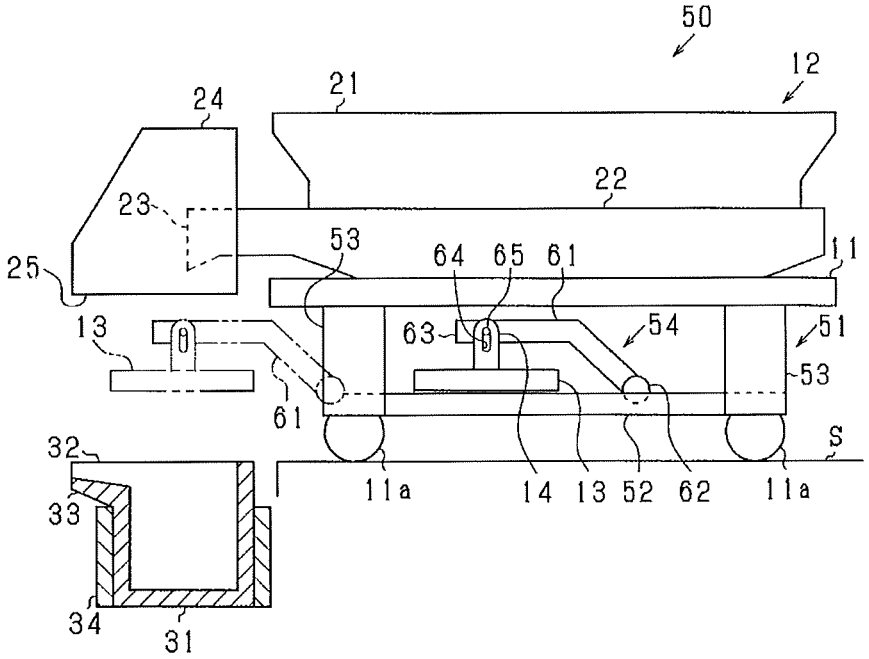
FIG. 3 is a side view schematically illustrating a melting material supply apparatus of a second embodiment.

Referring now to FIG. 3, a configuration of a melting material supply apparatus according to a second embodiment will be described. FIG. 3 is a side view schematically illustrating a melting material supply apparatus of the second embodiment. Parts of configurations overlapping with the first embodiment described above are designated with the same names and reference numerals, and parts of the configuration different from that of the first embodiment will be mainly described.

As illustrated in FIG. 3, in the melting material supply apparatus 50 of the second embodiment, the base portion 11 includes a furnace lid accommodating portion 51 for accommodating the furnace lid 13. The furnace lid accommodating portion 51 is provided below the melting material supply unit 12. Therefore, the melting material supply unit 12 and the hood 24 are located at a higher level by an amount corresponding to the furnace lid accommodating portion 51.

The furnace lid accommodating portion 51 has a base table portion 52 having a flat plate shape, and the column members 53 are provided at four corners of the base table portion 52. The melting material supply unit 12 is supported by these columns. The furnace lid 13 and the furnace lid supporting mechanism 54 configured to support the furnace lid 13 are provided in a space defined inside the column members 53.

The furnace lid supporting mechanism 54 supports the furnace lid 13 in a horizontal state, and is a mechanism for making the position of the furnace lid 13 movable. Therefore, the furnace lid supporting mechanism 54 corresponds to the furnace lid-supporting means and the furnace lid-moving means. FIG. 3 illustrates a state in which the furnace lid 13 is suspended and supported by the furnace lid supporting mechanism 54 in the furnace lid accommodating unit 51.

In the description given below, the state illustrated in FIG. 3 is defined as a reference position (waiting position). The furnace lid supporting mechanism 54 includes an arm member 61. The arm member 61 is attached at a proximal end 62 thereof to the base table portion 52. The proximal end 62 of the arm member 61 is attached to the melting material supply apparatus 50 at a center portion of in the width direction (a direction orthogonal to the paper plane of the drawing). The arm member 61 extends once from the proximal end 62 obliquely upward with respect to the movement direction, and then changes the direction into the horizontal direction.

The furnace lid 13 is provided at a center portion (a portion of center of gravity) with a coupling member 14 extending upward, and the coupling member 14 is coupled to a distal end 63 of the arm member 61. An elongated hole 64 extending along a vertical direction is formed in the coupling member 14 at a coupled portion between the arm member 61 and the coupling member 14. On the other hand, the arm member 61 is provided with a shaft portion 65 inserted into the elongated hole 64. In this manner, the furnace lid 13 is suspended and supported by a distal end 63 of the arm member 61 in a horizontal state via the shaft portion 65 of the arm member 61 provided in the elongated hole 64 of the coupling member 14.

As described above, the furnace lid supporting mechanism 54 has the configuration in which the arm member 61 is movable in the movement direction. This configuration may employ any suitable configuration such as that the arm member 61 is provided on a movable member which is movable on a rail on the base table portion 52. In this configuration, the furnace lid 13 is allowed to move in the horizontal direction from the waiting position at which it is accommodated in the furnace lid accommodating portion 51 to a position at which it protrudes in front of the furnace lid accommodating portion 51 as illustrated by a two-dot chain line as illustrated in FIG. 3. In this case, the furnace lid 13 is disposed below the hood 24, and is disposed above the opening 32 of the crucible 31. This is defined as an intermediate position.

Figure 4:
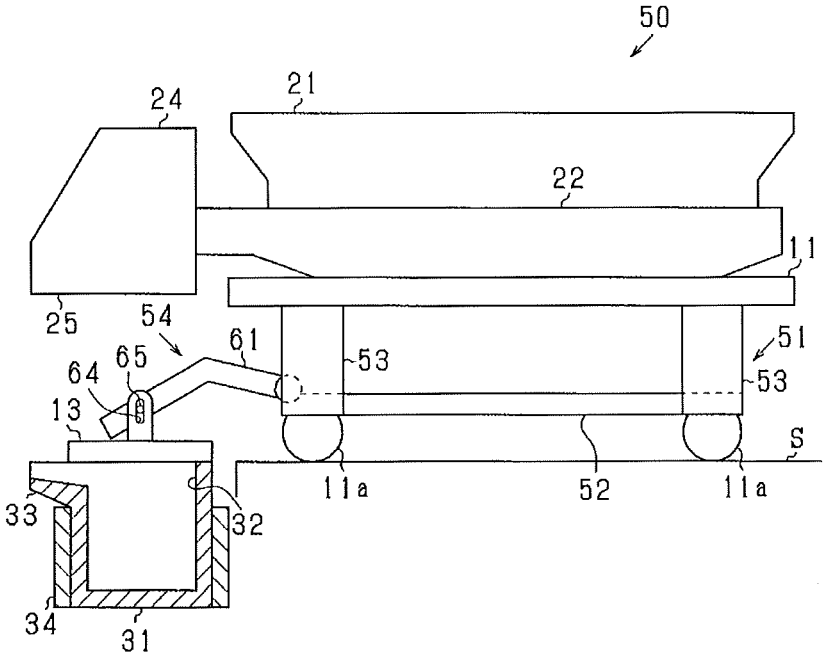
FIG. 4 is a schematic side view illustrating a state in which a furnace lid is placed at an opening.

In addition, in the furnace lid supporting mechanism 54, the arm member 61 is configured to be pivotable about the proximal end 62 as a center of the pivotal movement. Therefore, when the arm member 61 is pivoted about the proximal end 62 from a state in which the arm member 61 and the furnace lid 13 are at the intermediate position indicated by the two-dot chain line in FIG. 3, the furnace lid 13 moved downward as is and is placed at the opening 32 of the crucible 31. FIG. 4 is a schematic side view illustrating a state in which the furnace lid 13 is moved downward and is placed at the opening 32. As illustrated in FIG. 4, with the furnace lid 13 placed at the opening 32 of the crucible 31, the opening 32 is covered with the furnace lid 13.

As described above, the elongated hole 64 is formed in the coupling member 14 at the coupled portion between the distal end 63 of the arm member 61 and the coupling member 14 provided on the furnace lid 13, and the shaft portion 65 of the arm member 61 is provided in the elongated hole 64. Therefore, the shaft portion 65 of the arm member 61 is movable along the elongated hole 64, and the arm member 61 and the coupling member 14 are coupled with looseness at the coupled portion. In addition, with the shaft portion 65 formed into a circular shape in cross section, the coupling member 14 and the furnace lid 13 are also allowed to incline. Therefore, even when the crucible 31 is not in the horizontal state and is slightly inclined, the inclination is absorbed by this looseness. Accordingly, formation of the gap between the peripheral edge (contact portion) of the opening 32 and the furnace lid 13 is restricted. In this case, the elongated hole 64 and the shaft portion 65 constitute the inclination following mechanism.

In this manner, when the arm member 61 is raised from the position at which the furnace lid 13 is placed at the opening 32 of the crucible 31 by pivoting it about the proximal end 62, the furnace lid 13 is restored again to the intermediate position. In addition, when the arm member 61 and the furnace lid 13 are moved to be accommodated in the furnace lid accommodating portion 51, the furnace lid 13 is restored to the waiting position. In this manner, the furnace lid 13 is movable between the waiting position at which it is accommodated in the furnace lid accommodating portion 51 and the position at which it is placed at the opening 32 of the crucible 31 to cover the opening 32 via the intermediate position. The position to cover the opening 32 corresponds to the first position, and the reference position (waiting position) corresponds to the second position.

When the melting material supply apparatus 50 having the configuration described thus far is used to supply the melting material to the crucible 31, a procedure as described below is performed.

First, when the melting material is supplied, the furnace lid 13 is placed at the waiting position, and in this state, the melting material supply apparatus 10 is moved forward to place the hood 24 above the opening 32 of the crucible 31 as illustrated in FIG. 3. The melting material is supplied to the crucible 31 in this state.

Next, in a state of keeping the position of the melting material supply apparatus 50 as is, the furnace lid 13 is moved to and placed at the opening 32 of the crucible 31 via the intermediate position by the furnace lid supporting mechanism 54. Accordingly, the opening 32 of the crucible 31 is covered with the furnace lid 13. Therefore, heating of the melting material and the retention of the molten metal in the crucible 31 is achieved while heat dissipation is restricted.

In this case as well, even though the opening 32 of the crucible 31 is inclined, the inclination is absorbed by the looseness provided at the coupled portion between the distal end 63 of the arm member 61 and the coupling member 14.

When the molten metal in the crucible 31 is used, the furnace lid 13 is restored to the original waiting position by the furnace lid supporting mechanism 54. Accordingly, the state in which the opening 32 of the crucible 31 is opened is achieved. In this case, the material outlet port 25 of the hood 24 is positioned above the opening 32. Therefore, the supply of the melting material into the crucible 31 is performed at the position as is without moving the melting material supply apparatus 50.

According to the melting material supply apparatus 50 of the second embodiment described thus far, the following effects are achieved.

In the state in which the furnace lid 13 is placed in the furnace lid accommodating portion 51, that is, in the state where the furnace lid 13 is placed at the waiting position, the opening 32 of the crucible 31 is opened. Therefore, the supply of the melting material from the melting material supply unit 12 to the crucible 31 is allowed. After the melting material is supplied, the furnace lid 13 is moved and placed at the opening 32 of the crucible 31 by the furnace lid supporting mechanism 54 to cover the opening 32. By melting the melting material in this state, heat in the crucible 31 can hardly be dissipated to the outside. Accordingly, improvement in melting efficiency and working environment are achieved.

A point that the furnace lid 13 is used for the retention of the molten metal to improve efficiency of the melting operation is the same as the advantageous effect of the first embodiment.

The furnace lid 13 in the state of covering the opening 32 of the crucible 31 is provided below the hood 24. By moving the furnace lid 13 from below the hood 24 to the waiting position, the opening 32 of the crucible 31 is positioned below the hood 24, and thus the supply of the melting material to the crucible 31 is allowed. In other words, the melting material supply apparatus 50 do not have to be moved for supplying the melting material and for melting the supplied melting material, and thus the efficiency of the melting operation is improved correspondingly.

The furnace lid supporting mechanism 54 is provided below the melting material supply unit 12, and is configured to, in this position, move the furnace lid 13 between the position at which it is placed at the opening 32 of the crucible 31 and the waiting position. Therefore, an area for moving the furnace lid 13 and an area used for the melting material supply unit 12 may be provided separately in a vertical direction. Accordingly, complication in structure due to interference of one configuration with the other configuration is restricted.

Looseness is provided at the coupled portion between the distal end 63 of the arm member 61 and the coupling member 14 on the furnace lid 13, and in this state, the arm member 61 and the coupling member 14 are coupled. In addition, by the shaft portion 65 formed into a circular shape in cross section, the coupling member 14 and the furnace lid 13 are also allowed to incline. Therefore, with this looseness, even when the upper end of the crucible 31 is not in the horizontal state and is slightly inclined, the inclination is absorbed, and thus formation of a gap between the peripheral edge of the opening 32 and the furnace lid 13 is restricted.

Implementation of the present disclosure is not limited to the first and second embodiments described thus far, and the following implementation, for example, is also applicable.

(a) In the first embodiment described above, the furnace lid 13 is configured to be suspended and supported by the suspension lines 45, 46 attached to the center portion of the lateral member 44. Instead of this configuration, the suspension and support of the furnace lid 13 may be achieved by other configurations. For example, even in the case of suspending and supporting the furnace lid 13 by the same suspension lines 45, 46, a configuration in which a plurality of first suspension lines 45 are provided on the lateral member 44 to suspend and support the furnace lid 13 is also applicable. Furthermore, instead of a configuration using the pair of pivotable arm members 41 and the lateral member 44 as described in the first embodiment described above, a configuration in which the respective arm members 41 are fixed with the lateral member 44 disposed above the crucible 31 and a winding device for the first suspension line 45 provided on the lateral member 44 may be employed. In this case, the furnace lid 13 may be moved upward and downward by unwinding and winding the first suspension line 45 by the winding device.

In the same manner as the second embodiment, the lateral member 44 and the furnace lid 13 may be coupled by the coupling member 14 provided on the furnace lid 13. In this case, by providing looseness at the coupled portion in the same manner as the second embodiment, even though the coupling member 14 cannot be sagged and shortened in length like the suspension lines 45, 46, the furnace lid 13 may be inclined by the looseness so as to follow the inclination of the opening 32 of the crucible 31.

(b) In the second embodiment described above, the furnace lid 13 at the waiting position is configured to be accommodated in the furnace lid accommodating portion 51. Instead of this configuration, a space between the base table portion 52 and the traveling path S may also be used, and hence the furnace lid 13 may be retained at a lower position. In this configuration, the height of installation of the melting material supply unit 12 may be lowered, and hence the distance between the material outlet port 25 of the hood 24 and the opening 32 of the crucible 31 may be reduced to restrict the melting material from splashing around.

(c) In the second embodiment described above, the furnace lid 13 employs the configuration in which the furnace lid 13 is coupled to the arm member 61 with the coupling member 14. Instead of this configuration, the furnace lid 13 may be suspended and supported by the distal end 63 of the arm member 61 by using the suspension lines 45, 46 as in the first embodiment.

(d) In the second embodiment described above, the melting material supply apparatus 50 is movable along the movement direction by the wheels 11*a*. Instead of this configuration, the wheels 11*a* may be omitted, and the melting material supply apparatus 50 may be installed in a fixed state.

(d) In the respective embodiments described above, the configuration in which the hood 24 is provided on the melting material supply unit 12 is employed. Instead of this configuration, the hood 24 may be omitted.

(e) In the respective embodiments described above, the metal melting furnace employing the induction heating system using the induction coil 34 has been described. Instead of this configuration, a hybrid metal melting furnace in combination with heating by flames of a burner is also applicable. In this case, the furnace lid 13 is provided with a burner, and a gas supply tube for supplying fuel gas to the burner is also provided on the melting material supply apparatuses 10, 50.

REFERENCE SIGN LIST

10, 50 . . . melting material supply apparatus, 12 . . . melting material supply unit, 13 . . . furnace lid, 24 . . . hood, 25 . . . material outlet port, 31 . . . crucible, 32 . . . opening, 40 . . . furnace lid-supporter, 45 . . . suspension lines (inclination following mechanism), 55 . . . furnace lid supporting mechanism (furnace lid-supporting means, furnace lid moving means), 64 . . . elongated hole (inclination following mechanism), 65 . . . shaft portion (inclination following mechanism).

The invention claimed is:

1. A melting material supply apparatus combined with a metal melting furnace for melting a melting material supplied to a crucible of the metal melting furnace, the melting material supply apparatus comprising:

a melting material supply unit configured to supply a melting material to the crucible and to move between a supplying position for supplying the melting material to the crucible and a retracted position retracted therefrom and apart from the crucible which has been supplied with the melting material;

a furnace lid configured to cover an opening provided at a top of the crucible;

a furnace lid support mechanism configured to support the furnace lid in a horizontal state and to move the furnace lid between a first position at which the furnace lid is placed at the opening to cover the opening and a second position at which the opening is opened to allow a supply of the melting material, wherein when the furnace lid is in the second position while the melting material supply unit moves from the supplying position to the retracted position, the furnace lid support mechanism moves with the melting material supply unit to move the furnace lid away from the crucible, the melting material supply unit is provided on a base unit configured to move in a moving direction on a traveling path, the base unit has a base table portion provided below the melting material supply unit and a furnace lid accommodating portion provided between the base table portion and the melting supply unit, the furnace lid support mechanism has an arm member provided at the base table portion, said arm member supporting the furnace lid and configured to move in the furnace lid accommodating portion along the moving direction of the base unit, and the furnace lid protrudes in front of the furnace lid accommodating portion in the first position, is accommodated in the furnace lid accommodating portion in the second position, and is configured to move between the first position and the second position by movement of the arm member.

2. The melting material supply apparatus according to claim 1, wherein the melting material supply unit has a hood disposed above the opening at the time of supplying the melting material into the crucible and having a material outlet port configured to lead out the melting material downward, and the furnace lid at the first position is placed below the hood.

3. The melting material supply apparatus according to claim 1, wherein the furnace lid support mechanism has an inclination following mechanism configured to cause the furnace lid to incline so as to follow an inclination of a contact portion with respect to the opening.

4. A melting material supply apparatus combined with a metal melting furnace for melting a melting material supplied to a crucible of the metal melting furnace, the melting material supply apparatus comprising:

a melting material supply unit configured to supply a melting material to the crucible and to move between a supplying position for supplying the melting material to the crucible and a retracted position retracted therefrom and apart from the crucible which has been supplied with the melting material;

a furnace lid configured to cover an opening provided at a top of the crucible;

a furnace lid supporter configured to support the furnace lid in a horizontal state and to move the furnace lid between a first position at which the furnace lid is placed at the opening to cover the opening and a second position at which the opening is opened to allow a supply of the melting material, wherein when the furnace lid is in the second position while the melting material supply unit moves from the supplying position to the retracted position, the furnace lid supporter moves with the melting material supply unit to move the furnace lid away from the crucible, the melting material supply unit is provided on a base unit moving in a one direction on a traveling path, the furnace lid supporter has a pair of arm members provided at a front end of the base unit and supporting the furnace lid, the pair of arm members are pivotable about a proximal end thereof as an axis of pivotal movement, when the pair of arm members are pivoted to a downward position, the furnace lid is placed at the first position and when the pair of arm members are pivoted to a raised position, the furnace lid is placed at the second position.

5. The melting material supply apparatus according to claim 4, wherein the melting material supply unit has a hood disposed above the opening at the time of supplying the melting material into the crucible and having a material outlet port configured to lead out the melting material downward, and the furnace lid at the first position is placed in front of the hood, and the furnace lid at the second position is placed above the hood, and the pair of arm members moves the furnace lid so as to circumvent the hood when moving the furnace lid between the first position and the second position.

6. The melting material supply apparatus according to claim 4, wherein the furnace lid supporter has an inclination following mechanism configured to cause the furnace lid to incline so as to follow an inclination of a contact portion with respect to the opening.

* * * * *